US009512596B2

(12) United States Patent
Kang et al.

(10) Patent No.: US 9,512,596 B2
(45) **Date of Patent: *Dec. 6, 2016**

(54) HYBRID EXCAVATOR BOOM ACTUATING SYSTEM AND METHOD FOR CONTROLLING SAME

(75) Inventors: Byung Il Kang, Gyeonggi-Do (KR); Ki Hwan Hong, Incheon (KR)

(73) Assignee: Doosan Infracore Co., Ltd., Incheon (KR)

( * ) Notice: Subject to any disclaimer, the term of this patent is extended or adjusted under 35 U.S.C. 154(b) by 637 days.

This patent is subject to a terminal disclaimer.

(21) Appl. No.: 13/996,982

(22) PCT Filed: Dec. 26, 2011

(86) PCT No.: PCT/KR2011/010083

§ 371 (c)(1),
(2), (4) Date: Jun. 21, 2013

(87) PCT Pub. No.: WO2012/087080

PCT Pub. Date: Jun. 28, 2012

(65) Prior Publication Data

US 2013/0291531 A1 Nov. 7, 2013

(30) Foreign Application Priority Data

Dec. 24, 2010 (KR) ..... 10-2010-0135014

(51) Int. Cl.
*E02F 9/22* (2006.01)
*E02F 9/20* (2006.01)

(52) U.S. Cl.
CPC ..... *E02F 9/2278* (2013.01); *E02F 9/2075* (2013.01); *E02F 9/2235* (2013.01); *E02F 9/2282* (2013.01); *E02F 9/2292* (2013.01); *E02F 9/2296* (2013.01)

(58) Field of Classification Search
CPC ..... E02F 9/2217; F15B 11/17; F15B 21/14; F15B 2211/20576; F15B 2211/31511; F15B 2211/353; F15B 2211/6652; F15B 2211/88; F15B 11/0423; F15B 11/055
(Continued)

(56) References Cited

U.S. PATENT DOCUMENTS 5,649,422 A * 7/1997 Baginski ..... B66F 9/22 60/431
7,043,906 B2 * 5/2006 Suzuki ..... E02F 9/2217 60/422
(Continued)

FOREIGN PATENT DOCUMENTS

JP 2007-113756 A 5/2007
JP 2007-263160 A 10/2007
(Continued)

OTHER PUBLICATIONS

Search Report dated Aug. 3, 2012 and written in Korean with English translation attached for International Patent Application No. PCT/KR2011/010083 filed Dec. 26, 2011, 5 pages.

*Primary Examiner* — John K Fristoe, Jr.
*Assistant Examiner* — Matthew Wiblin
(74) *Attorney, Agent, or Firm* — John D. Veldhuis-Kroeze; Westman, Champlin & Koehler, P.A.

(57) ABSTRACT

The present disclosure relates to a hybrid excavator boom actuating system and to a method for controlling the same. The boom actuating system comprises: an electric motor serving as a motor or a generator; an ultra capacitor for storing electricity generated by the electric motor; a hydraulic pump motor driven by the electric motor to supply hydraulic fluid to a boom; a boom control valve which has a closed circuit for selectively connecting or disconnecting an outlet line and an inlet line of the hydraulic pump motor
(Continued)

to or from a head or a rod side of the boom; a main pump driven by the engine to supply hydraulic fluid to a bucket, a travel motor or an arm; a motor bypass valve connected to the outlet line and the inlet line to interconnect the outlet line and the inlet line or disconnect the outlet line from the inlet line; and a controller for controlling the electric motor, the hydraulic pump motor, the boom control valve and the motor bypass valve.

7 Claims, 6 Drawing Sheets

(58) Field of Classification Search
USPC ..... 60/414, 421, 484
See application file for complete search history.

(56) References Cited

U.S. PATENT DOCUMENTS

| | | | | |
|---|---|---|---|---|
| 2005/0246082 | A1* | 11/2005 | Miki | E02F 9/2075 701/50 |
| 2008/0110166 | A1* | 5/2008 | Stephenson | E02F 9/2217 60/414 |
| 2009/0165450 | A1* | 7/2009 | Cherney | E02F 9/2203 60/413 |
| 2012/0055050 | A1* | 3/2012 | Patel | E02F 9/2025 37/411 |
| 2012/0324877 | A1* | 12/2012 | Kang | E02F 3/435 60/327 |

FOREIGN PATENT DOCUMENTS

| | | | |
|---|---|---|---|
| JP | 2009-127643 | A | 6/2009 |
| KR | 10-1998-0009679 | A | 4/1998 |

* cited by examiner

HYBRID EXCAVATOR BOOM ACTUATING SYSTEM AND METHOD FOR CONTROLLING SAME

CROSS-REFERENCE TO RELATED APPLICATION

This Application is a Section 371 National Stage Application of International Application No. PCT/KR2011/010083, filed Dec. 26, 2011 and published, not in English, as WO2012/087080 on Jun. 28, 2012.

FIELD OF THE DISCLOSURE

The present disclosure relates to a hybrid excavator boom actuating system and a method for controlling the same, and more particularly, to a hybrid excavator boom actuating system, which drives a hydraulic pump motor by an electric motor to operate a boom, and recovers regenerative power of the boom by the electric motor to improve fuel efficiency, and a method for controlling the same.

BACKGROUND OF THE DISCLOSURE

In general, an excavator is operated by two main pumps driven by an engine, and a main control valve provided with a plurality of spools for distributing hydraulic fluid pressurized by the two main pumps to a boom, an arm, a bucket cylinder, and a swing motor and recovering the hydraulic fluid therein.

Further, an excavator boom actuating system is configured so that when hydraulic fluid is supplied to a cylinder head side of a boom cylinder by main pumps, the boom ascends, and when hydraulic fluid is supplied to a rod side of the cylinder, the boom descends. The ascending and the descending of the boom is determined according to an operation direction of a boom joystick, and an ascending speed and a descending speed of the boom are determined according to an amount of operation of the joystick.

The boom receives hydraulic fluid in the boom cylinder by one main pump at an initial stage, and when a large flow rate is necessary, the boom receives hydraulic fluid from two main pumps by the main control valve.

In general, a hydraulic system for actuating the boom has very low efficiency, and especially, small flow rate section, in which the boom cylinder is driven by one main pump, has much lower energy efficiency than that of a large flow rate section, in which two main pumps are used. That is, when the boom ascends, a lot of flow loss is generated in the main control valve to a fine manipulation operation section corresponding to approximately ½ of a maximum supply flow rate of the main pump, so that energy efficiency is very low.

Further, energy supplied while the boom ascends is stored in a form of potential energy of the boom, and an amount of regenerable energy of the boom is predicted as approximately 90% of supply energy. However, according to a hydraulic system of an excavator in the related art, most of the regenerable energy of the boom stored in the form of the potential energy of the boom is converted into heat by meter-out control in the main control valve when the boom descends, to be lost when the boom descends.

In a case of the flow rate supplied to the boom cylinder by distributing the flow rate to each actuator during general excavating work, the number of cases where a ratio of the flow rate to a maximum flow rate of the main pump is equal to or larger than a predetermined ratio is small, and in view of power, a case where maximum engine power is completely used is hardly generated. Accordingly, a use of a hydraulic pump motor with a large capacity in order to respond to momentarily increasing power requirement/regenerative power, and a large flow rate is not efficient.

The discussion above is merely provided for general background information and is not intended to be used as an aid in determining the scope of the claimed subject matter.

SUMMARY

This summary and the abstract are provided to introduce a selection of concepts in a simplified form that are further described below in the Detailed Description. The summary and the abstract are not intended to identify key features or essential features of the claimed subject matter, nor are they intended to be used as an aid in determining the scope of the claimed subject matter.

An embodiment of the present disclosure is conceived to solve the problem in the related art, and provides a hybrid excavator boom actuating system for minimizing a loss of energy, securing operational performance of a boom, and recovering regenerable energy of the boom when excavating work that is a main usage of an excavator is performed while using an electric motor, and a method of controlling the same.

Further, an embodiment of the present disclosure provides a hybrid excavator boom actuating system capable of being stably operated at an initial stage when the boom descends, and a method of controlling the same.

A hybrid excavator boom actuating system according to the present disclosure includes: an electric motor serving as a motor or a generator; an ultra capacitor for storing electrical energy generated by the electric motor; a hydraulic pump motor driven by the electric motor to supply hydraulic fluid to a boom; a boom control valve which has a closed circuit for selectively connecting or disconnecting an outlet line and an inlet line of the hydraulic pump motor to or from a head or a rod side of the boom; a main pump driven by the engine to supply hydraulic fluid to a bucket, a travel motor or an arm; a motor bypass valve connected to the outlet line and the inlet line to interconnect the outlet line and the inlet line or disconnect the outlet line from the inlet line; and a controller for controlling the electric motor, the hydraulic pump motor, the boom control valve and the motor bypass valve.

Further, when descending of the boom is initiated, the controller may sop the operation of the hydraulic pump motor switch the motor bypass valve so that the outlet line and the inlet line are interconnected In a case where a flow rate discharged from the head of the boom after the descending of the boom is initiated is equal to or larger than a predetermined value, the controller may operate the hydraulic pump motor and switch the motor bypass valve so as to disconnect the outlet line and the inlet line.

A method of controlling the hybrid excavator boom driving system according to the present disclosure includes: detecting an amount of operation of a boom joystick; determining whether a boom descends according to the operation of the boom joystick; when descending of the boom is initiated, stopping an operation of the hydraulic pump motor and switching the motor bypass valve so as to interconnect an outlet line and an inlet line; determining whether the flow rate discharged from a head of the boom is equal to or larger than a predetermine value; and when the flow rate is equal to or larger than the predetermine value, operating the hydraulic pump motor, and switching the motor bypass valve so as to disconnect the outlet line and the inlet line.

The hybrid excavator boom actuating system and a method of controlling the same according to the present disclosure may achieve the effects of minimizing a loss of energy, securing operational performance of a boom, and recovering regenerable energy of the boom when excavating work that is a main usage of an excavator is performed while using an electric motor.

Further, it is possible to stably drive the system even if the discharged flow rateflow rate of the boom cylinder is not sufficient by supplying the flow rate of the inlet line to the outlet line by connecting the outlet line and the inlet line through the motor bypass valve at an initial stage at which the boom descending is initiated.

Further, it is possible to prevent cavitation generable in the outlet line by controlling the flow rate of the inlet line to be supplied to the outlet line at the initial state of the descending of the boom, at which the hydraulic pump motor may be unstably operated.

DETAILED DESCRIPTION

Figure 1:
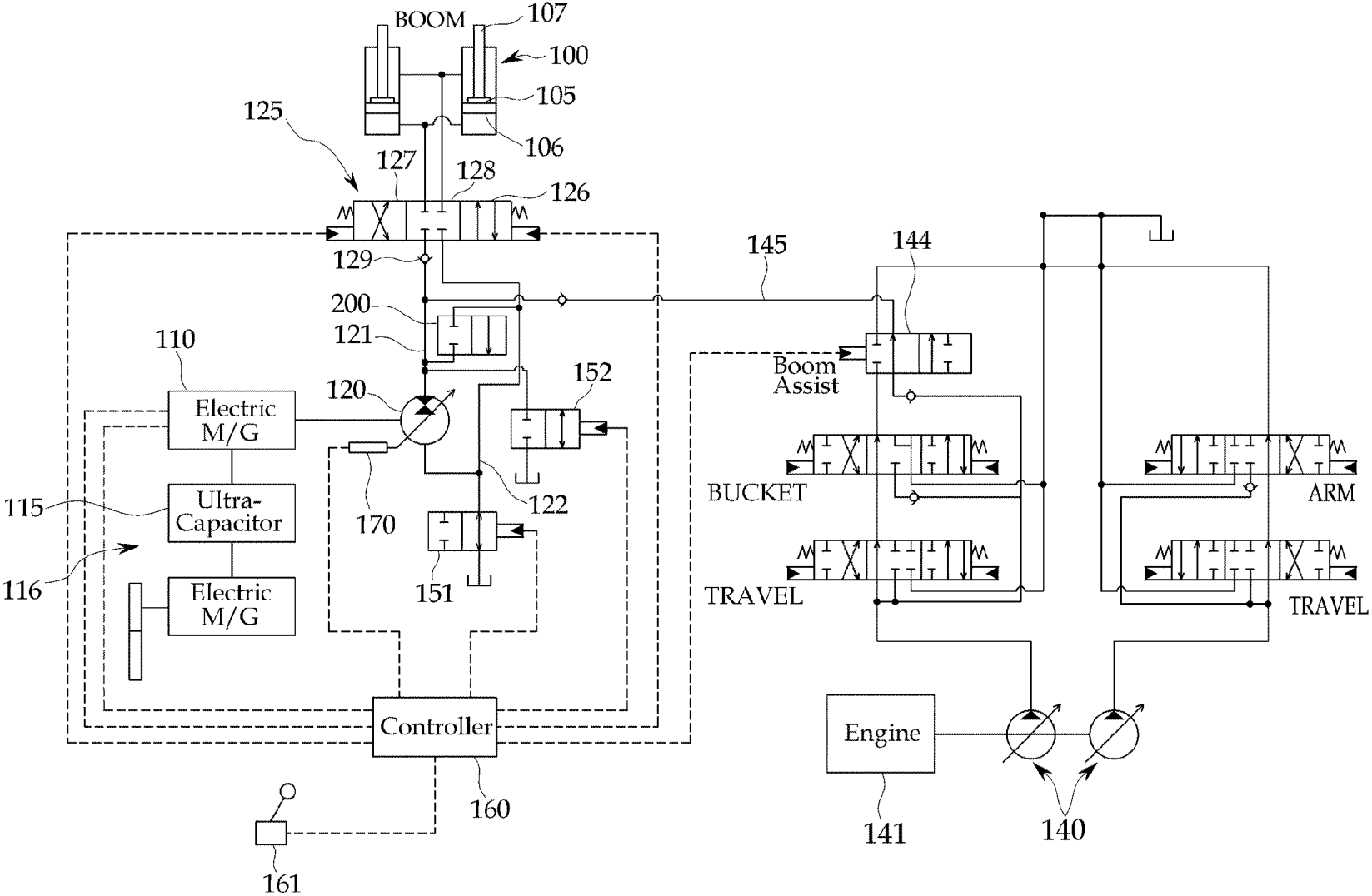
FIG. 1 is a configuration diagram of a hybrid excavator boom actuating system according to an exemplary embodiment of the present disclosure.

Hereinafter, an exemplary embodiment of a hybrid excavator boom actuating system and a method of controlling the same according to the present disclosure will be described with reference to the accompanying drawings. In the process, thicknesses of lines or sizes of constituent elements illustrated in the drawing, and the like, may be exaggerated for clarity and ease of description. Further, the terms used in the description are defined considering the functions of the present disclosure and may vary depending on the intention or usual practice of a user or operator.

Figure 2:
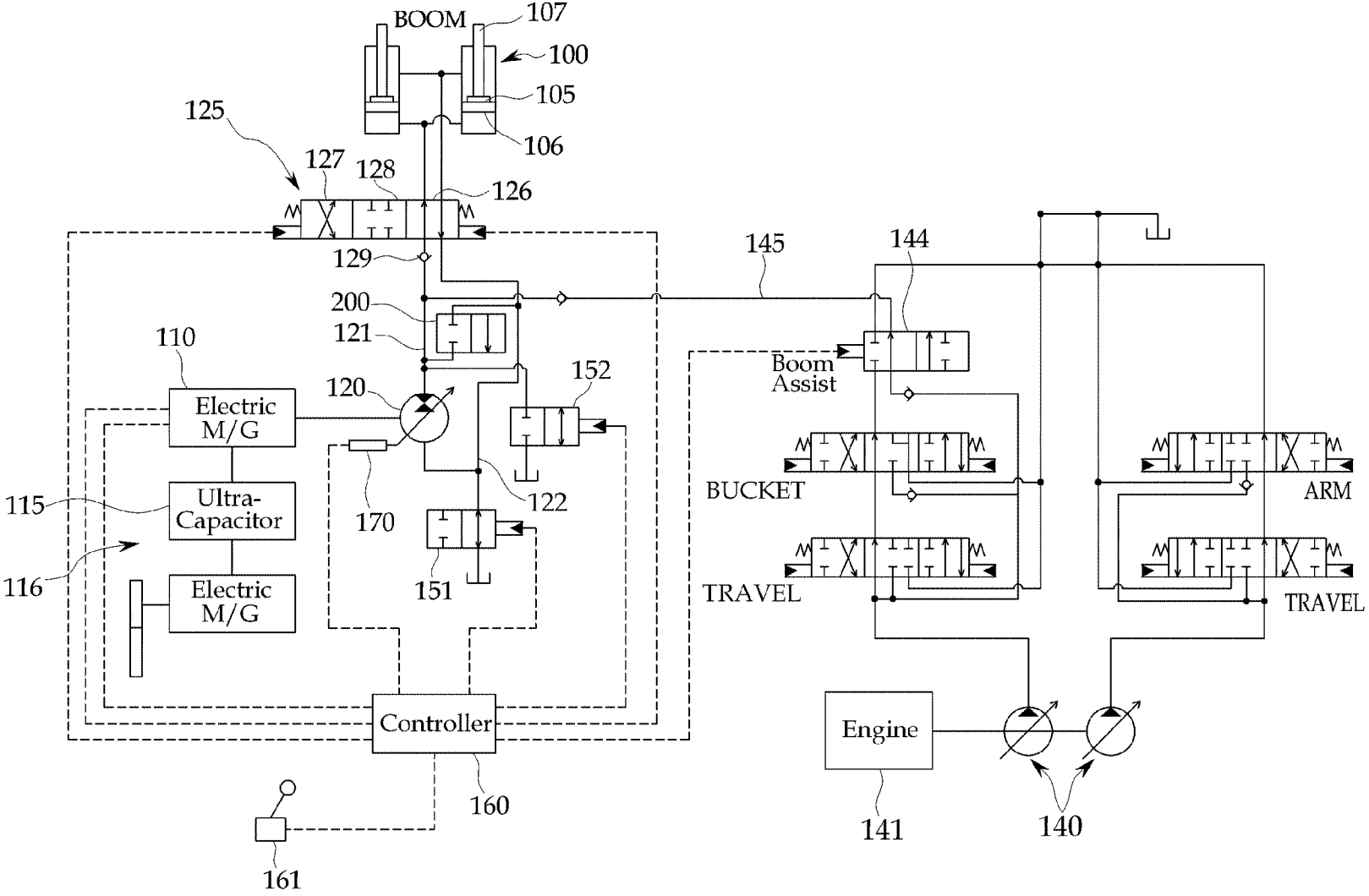
FIG. 2 is a configuration diagram illustrating a boom ascending state of FIG. 1.
Figure 4:
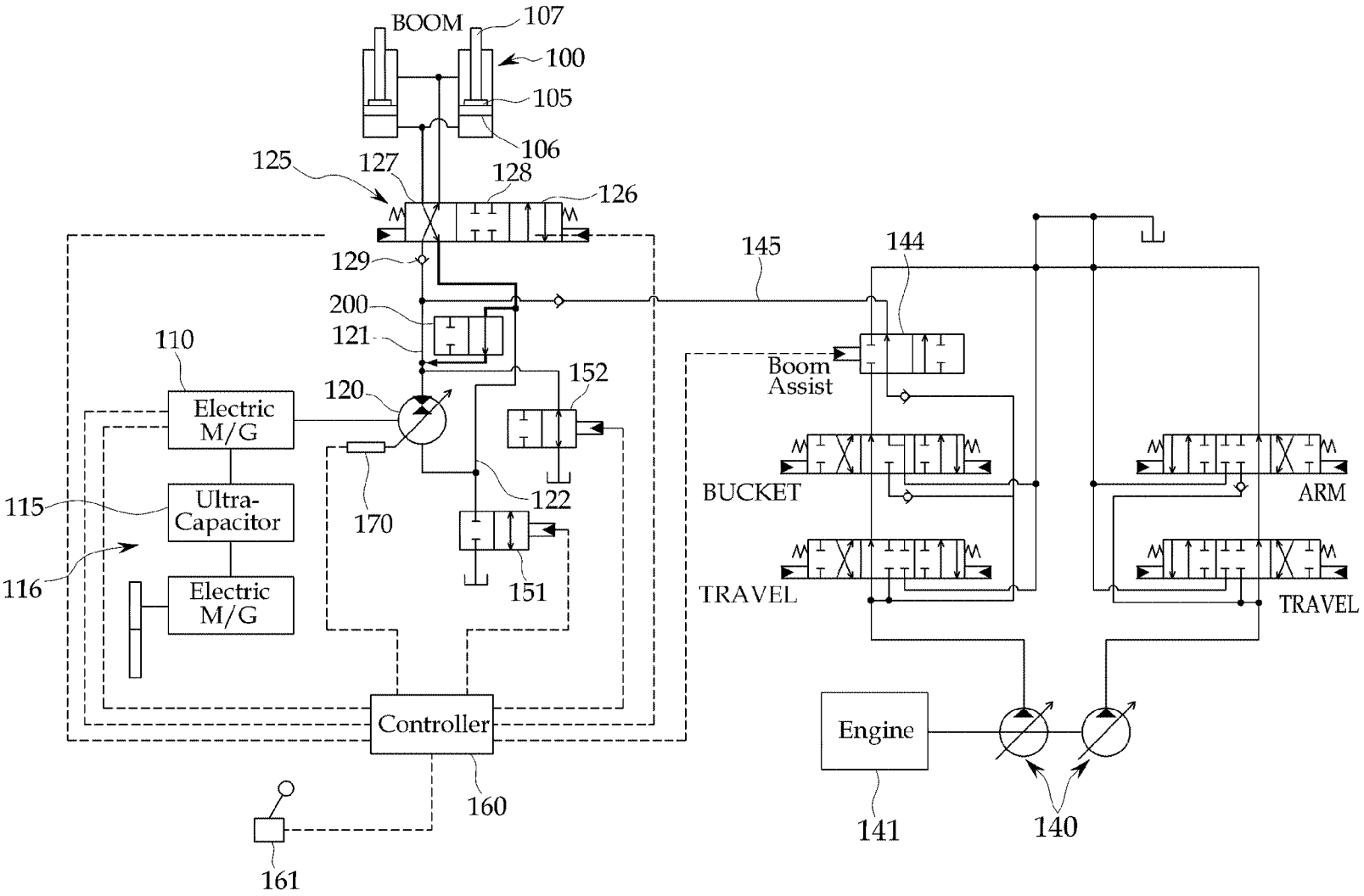
Figure 5:
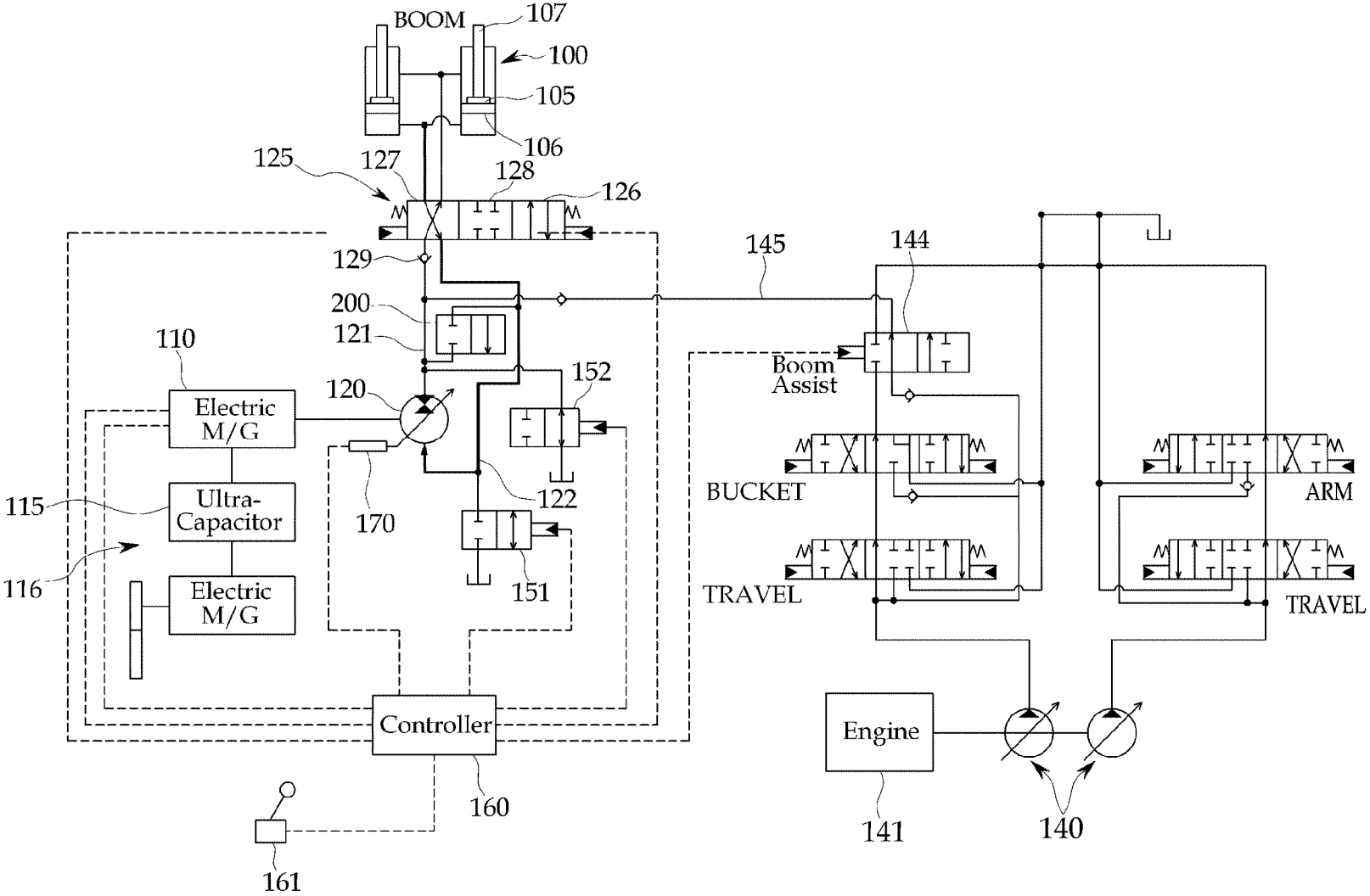
Figure 6:
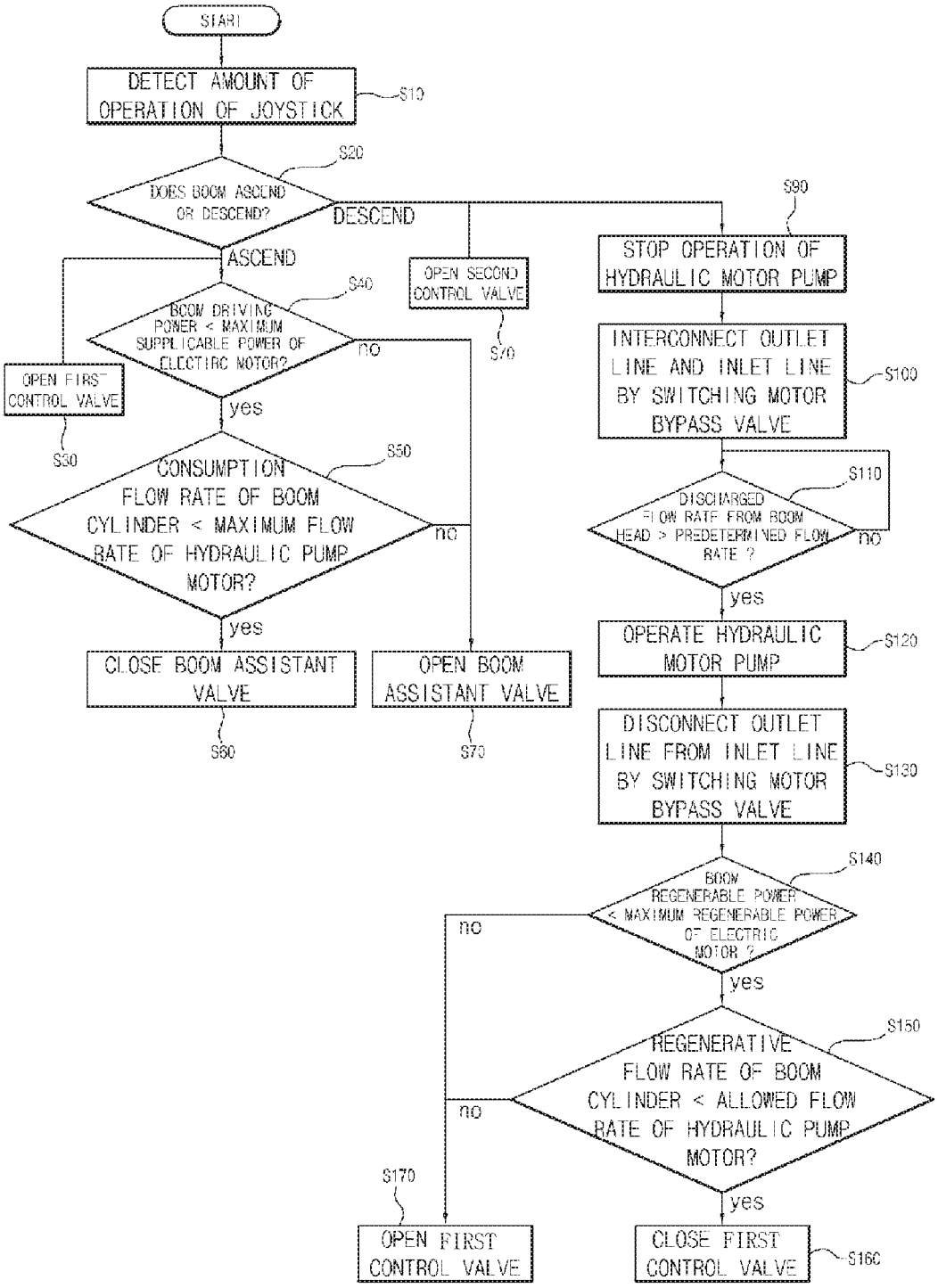
FIG. 6 is a flowchart of a method of controlling a hybrid excavator boom actuating system according to an exemplary embodiment of the present disclosure.

FIG. 1 is a configuration diagram of a hybrid excavator boom actuating system according to an exemplary embodiment of the present disclosure, FIG. 2 is a configuration diagram illustrating a boom ascending state of FIG. 1, FIGS. 3 to 5 are configuration diagrams illustrating a boom descending state of FIG. 1, and FIG. 6 is a flowchart of a method of controlling a hybrid excavator boom actuating system according to an exemplary embodiment of the present disclosure.

Referring to FIG. 1, a hybrid excavator boom driving system according to an exemplary embodiment of the present disclosure includes an electric motor 110 serving as a motor or a generator, an electricity storage device 116 including an ultra capacitor 115 and the like for storing electricity generated in the electric motor 110, a hydraulic pump motor 120 driven by the electric motor 110 to supply hydraulic fluid to a boom 100, a boom control valve 125 for selectively connecting or disconnecting an outlet line 121 and an inlet line 122 of the hydraulic pump motor 120 to or from a head 106 or a rod 107 side of the boom 100, and a motor bypass valve 200 connected to the outlet line 121 and the inlet line 122 to interconnect or disconnect the outlet line 121 and the inlet line 122. In the present exemplary embodiment, the electricity storage device 116 may receive most power by driving a motor/generator 142 connected to an engine 141. In the drawings, a connection structure of the motor/generator 142 and the engine 141 is not illustrated, but the motor/generator 142 and the engine 141 may be connected by various publicly-known methods, such as a method by which the motor/generator 142 may be connected between the engine 141 and the main pumps 140 to be described below. In the meantime, in the present exemplary embodiment, an example, in which the electricity storage device 116 uses the ultra capacitor 115 capable of achieving speedy charging and improving charging efficiency, compared to other electricity storing means, as a device for storing electrical energy, is described. However, the electricity storage device 116 is not limited to the present exemplary embodiment, and the electricity storage device 116 may use any one among various types of secondary batteries generally used in a hybrid system, in addition to the ultra capacitor 115.

The boom control valve 125 is connected to the main pumps 140 by a boom assistant line 145 through which the hydraulic fluid is supplied. The number of main pumps 140 is two, and the main pumps 140 are driven by a separate power source separately disposed from the electric motor 110 providing power to the hydraulic motor pump 120, like the engine 141 or an electric motor generator (not illustrated), to provide the hydraulic fluid to other operation systems, except for the bucket, a travel motor, or the boom, such as an arm. The hydraulic pump motor 120 is connected with an outlet line 121 through which the hydraulic fluid is discharged, and an inlet line 122 through which the hydraulic fluid flows in. The outlet line 121 and the inlet line 122 are connected to the head 106 or the rod 107 side of the boom cylinder 105 by the boom control valve 125. That is, the outlet line 121 and the inlet line 122 are connected or disconnected by the boom control valve 125.

The boom control valve 125 includes a forward connection portion 126 for connecting the outlet line 121 and the inlet line 122 in a forward direction to raise the boom 100, a crossing connection portion 127 for connecting the outlet line 121 and the inlet line 121 in an opposite way, and a disconnection portion 128 for disconnecting the outlet line 121 from the inlet line 122. The boom control valve 125 is operated by an electronic proportional control valve or a separate pilot hydraulic line, and a connection state of the outlet line 121 and the inlet line 122 is switched. In the present exemplary embodiment, the boom control valve 125 which is configured in a form of an electronic proportional control valve controlled by a controller 160 is described as an example. In addition, the boom control valve 125 may be configured so as to be operated by a publicly-known pilot hydraulic line. In this case, the boom control valve 125 may be controlled by a pilot hydraulic line discharged by an operation of the boom joystick 161, rather than the controller 160, and then supplied through the pilot hydraulic line.

The motor bypass valve 200 is connected between the outlet line 121 and the inlet line 122, and is configured to interconnect the outlet line 121 and the inlet line 122 so that the flow rate of the inlet line 122 is supplied to the outlet line 121, or disconnect the outlet line 121 from the inlet line 122.

The outlet line 121 of the hydraulic pump motor 120 is provided with a check valve 129 for preventing a reverse flow, and the boom assistant line 145 is connected to the outlet line 121 of an upstream side of the check valve 129.

A first control valve 151 connected with a tank is connected between the hydraulic pump motor 120 and the outlet line 121 of the boom control valve 125. A second control valve 152 connected with the tank is connected between a connection portion of the boom assistant line 145 and the hydraulic pump motor 120. The operations of the electric motor 110, the hydraulic pump motor 120, the boom control valve 125, the motor bypass valve 200, the first control valve 151, and the second control valve 152 are controlled by the controller 160.

First, an operation of the boom actuating system when the boom ascends will be described below.

Referring to FIG. 2, when an ascending signal of the boom 100 is input in the controller 160 from the boom joystick 161, the controller 160 drives the hydraulic pump motor 120 with a pump by controlling the electric motor 110 in response to the operation of the boom joystick 161. Further, an outlet side of the hydraulic pump motor 120 is connected with the head 106 side of the boom 100 through the outlet line 121 by switch of the boom control valve 125, and the rod 107 side of the boom 100 is connected to an intake side of the hydraulic pump motor 120 by the inlet line 122 of the hydraulic pump motor 120. Further, the motor bypass valve 200 is in a state of disconnecting the outlet line 121 and the inlet line 122. In this case, the boom 100 starts to ascend by the flow rate discharged from the hydraulic pump motor 120, and a speed of the boom 100 is controlled by a rotation speed of the electric motor 110 and a tilting angle controlled by a tilting angle control device 170.

Here, a closed circuit is formed between the hydraulic pump motor 120 and the boom cylinder 105, and the flow rate supplied from the boom cylinder 105 to the hydraulic pump motor 120 is deficient, compared to that supplied from the hydraulic pump motor 120 to the boom cylinder 105 due to a difference of an area of the cylinder. In this case, the deficient amount of fluid is supplied from the tank through the connection of first control valve 151.

Further, the controller 160 calculates power of the electric motor 110 from torque and a rotation speed of the electric motor 110, and the flow rate of the hydraulic pump motor 120 is monitored through the tilting angle and the rotation speed output from the tilting angle control device 170.

In the meantime, in a case where a control signal of the boom joystick 161 increases so that a supply flow rate of the hydraulic pump motor 120 is exceeded or a capacity of the electric motor 110 is exceeded, the controller 160 supplies the flow rate of the main pump 140 to the boom cylinder 105 by controlling the boom assistant valve 144. The controller 160 controls opening/closing of the boom assistant valve 144 so that the boom cylinder 105 responds to the signal of the boom joystick 161. The boom assistant valve 144 is switched to the right side by the controller 160 in a disconnection state, and the boom assistant line 145 is connected to the main pumps 140 driven by the engine 141. Since the aforementioned boom assistant line 145 supplies the hydraulic fluid to the discharge line 121 by the check valve only when necessary, when the boom ascends, the boom assistant valve 144 may be always maintained in an opened state. However, when the boom assistant valve 144 is opened when the boom ascends as described above, a pressure load is applied to the main pumps 140 to cause another type of energy loss, so that it is more preferable to open the boom assistant valve 144 only when necessary, such as when the flow rate is deficient, as described above.

Next, an operation of the boom actuating system when the boom descends will be described below.

When a descending signal of the boom 100 is input in the controller 160 from the boom joystick 161, the hydraulic pump motor 120 is operated by the flow rate recovering from a chamber of the head 106 side of the boom cylinder 105 by the controller 160. The electric motor 110 is operated as a generator by driving force of the hydraulic pump motor 120, and the generated power is stored in the electricity storage device 116.

Figure 3:
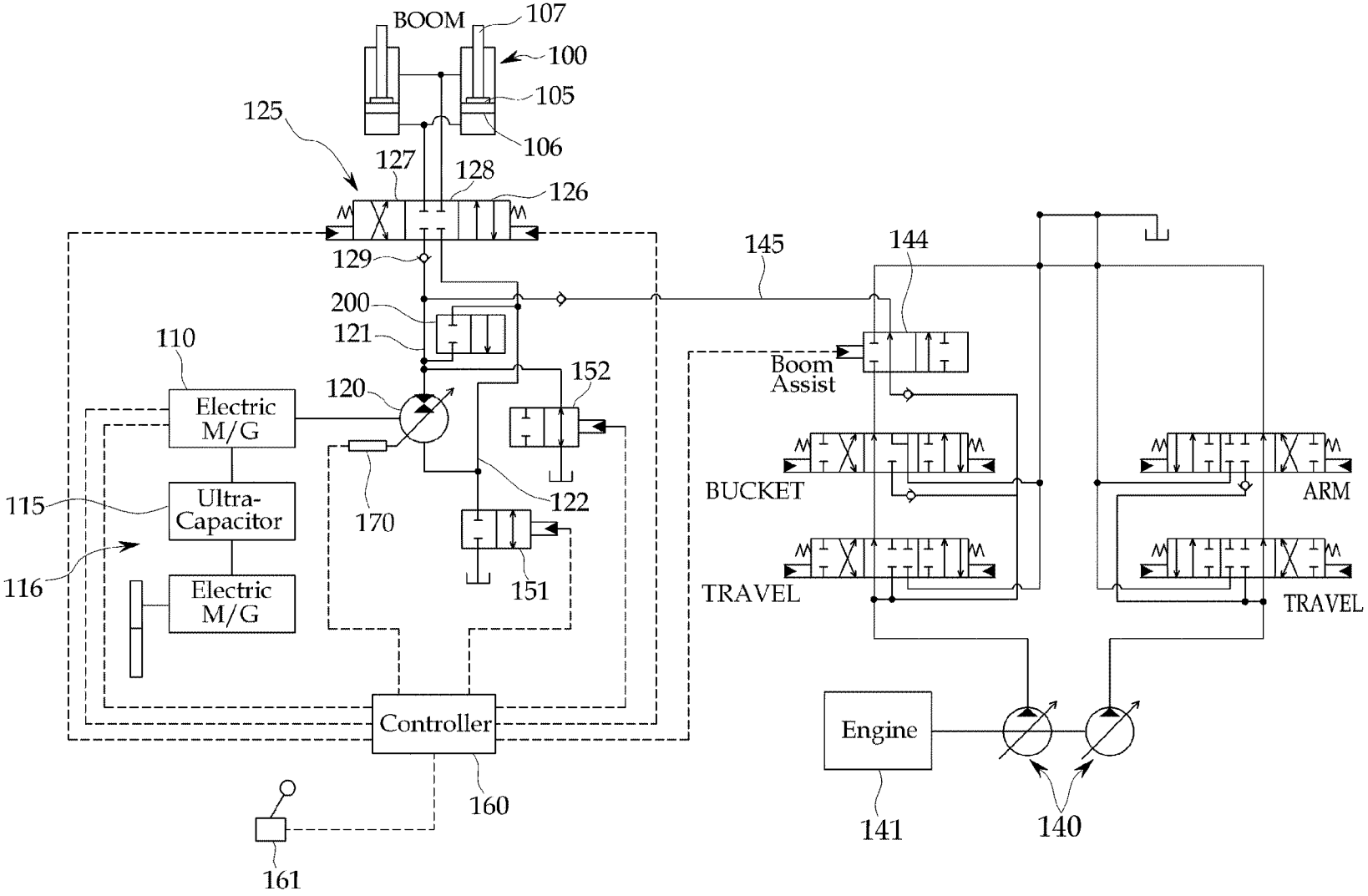
FIGS. 3 to 5 are configuration diagrams illustrating a boom descending state of FIG. 1.

Particularly, when the descending signal of the boom 100 is input, the controller 160 stops an ascending operation of the boom 100. In this case, as illustrated in FIG. 3, the boom control valve 125 is switched to the disconnection portion 128, and the motor bypass valve 200 maintains a state of disconnecting the outlet line 121 from the inlet line 122. However, in the present exemplary embodiment, it is described that the motor bypass valve 200 is disconnected in a state where the ascending operation of the boom 100 is stopped, but the present disclosure may be configured in a state where the outlet line 121 and the inlet line 122 are connected according to an exemplary embodiment.

Next, the controller 160 initiates a descending operation of the boom 100. A descending speed of the boom 100 is controlled by controlling the rotation speed of the hydraulic pump motor 120 by controlling the tilting angle through the tilting angle control device 170, and the quantity of generated power of the electric motor 110 is controlled together. In this case, the flow rate supplied to the intake side of the hydraulic pump motor 120 is small at an initial stage of the boom descending. As described above, the flow rate supplied to the hydraulic pump motor 120 needs to be supplied to a chamber of the rod 107 side of the boom cylinder 100 via the hydraulic pump motor 120 and the boom control valve 125. However, since the flow rate supplied from the chamber at the chamber 106 side of the boom cylinder 100 is very small at the initial stage of the boom descending, it is difficult to form pressure for supplying the flow rate to a chamber at the rod 107 side of the boom cylinder 100 while driving the hydraulic pump motor 120. Accordingly, the sufficient flow rate for the boom descending is not supplied to the chamber at the rod 107 side of the boom cylinder 100, so that cavitation is generated, and thus a hydraulic component, such as the boom cylinder 100 and the hydraulic pump motor 120, may be damaged due to an impact caused by the cavitation. Further, a control and an operational characteristic of the hydraulic pump motor 120 become very unstable, so that there are concerns regarding instability of the boom actuating system.

Accordingly, in the present disclosure, as illustrated in FIG. 4, by the switching of the boom control valve 125, the head 106 side of the boom 100 is connected to the intake side of the hydraulic pump motor 120 by the inlet line 122, and the rod 107 side of the boom 100 is connected to the discharge side of the hydraulic pump motor 120 by the outlet line 121. The motor bypass valve 200 is switched so that the outlet line 121 is connected with the inlet line 122.

Accordingly, all of the flow rate at the head 106 side of the boom cylinder 105 are s discharged along the inlet line 122, and are supplied to the outlet line 121 side through the motor bypass valve 200. A part of the flow rate supplied to the outlet line 121 side is supplied to the rod 107 side of the boom cylinder 105, and the surplus flow rate is drained to the tank through the second control valve 152, or drives the hydraulic pump motor 120 to drive the electric motor 110 as the generator.

As described above, at the initial state of the boom descending, the connection state of the motor bypass valve 200 is configured so that the flow rate discharged from the inlet line 122 may be supplied to the outlet line 121, and the discharged flow rate of the boom cylinder 105 is increased by using the flow rate supplied to the outlet line 121, thereby stably driving the boom actuating system.

When the descending speed of the boom cylinder 105 is increased and the flow rate of the head 106 side of the boom is sufficient to be equal to or larger than a predetermined flow rate after the boom descending starts and then a predetermined time elapses, the controller 160 determines that the hydraulic pump motor 120 may be stably operated. Accordingly, as illustrated in FIG. 5, the outlet line 121 is disconnected from the inlet line 122 by switching the motor bypass valve 200, and the hydraulic pump motor 120 is operated.

In this case, a closed circuit is configured between the hydraulic pump motor 120 and the cylinder, and according to the increase in the flow rate supplied to the hydraulic pump motor 120, the flow rate supplied from the boom cylinder 105 to the hydraulic pump motor 120 is larger than the flow rate supplied from the hydraulic pump motor 120 to the boom cylinder 105 due to an area difference of the boom cylinder 105 according to the existence or non-existence of the rod 107. In this case, the surplus flow rate supplied from the hydraulic pump motor 120 to the boom cylinder 105 is discharged to the tank because the second control valve 152 connected to the outlet line 121 becomes in a connection state by the signal of the controller 160.

Further, in a case where an allowed flow rate of the hydraulic pump motor 120 is exceeded, or the flow rate exceeding the generation capacity of the electric motor 110 is discharged from the boom cylinder 105 and then supplied to the hydraulic pump motor 120, the controller 160 may discharge the surplus flow rate exceeding the capacity of the hydraulic pump motor 120 and the electric motor 110 to the tank by operating the first control valve 151 to be in the connection state. In this case, the first control valve 151 serves to discharge the surplus quantity of the hydraulic fluid flowing from the boom cylinder 105 to the hydraulic pump motor 120 through the inlet line 122 to the tank.

To sum up with reference to FIGS. 2 to 5, the first control valve 151 may supply the deficient hydraulic fluid to the boom cylinder 105 by connecting the tank when the boom 100 ascends, and on the contrary, the first control valve 151 is disconnected when the boom 100 descends, except for a time when the surplus flow rate is generated from the boom cylinder 105 to the hydraulic pump motor 120 side.

Further, the second control valve 152 is in the disconnected state when the boom 100 ascends, and is connected when the boom 100 descends. Accordingly, the flow rate discharged from the chamber of the head 106 side of the boom cylinder 100 returns to the tank by passing through the crossing connection portion 127 of the boom control valve 125, the inlet line 122, and the hydraulic pump motor 120, and then passing through the second control valve 152, or is supplied to the chamber of the rod 107 side of the boom cylinder 100. The electric motor 110 is operated as the generator by the hydraulic pump motor 120 driven by the aforementioned flow rate, and the electrical energy generated as described above is stored in the electricity storage device 116. That is, when the boom descends, the hydraulic pump motor 120 is operated as the load, there may occur a problem that the sufficient flow rate is not supplied to the rod 107 side of the boom cylinder 100 due to the load. In the present exemplary embodiment, the sufficient flow rate is supplied to the rod 107 side of the boom cylinder 100 by driving the motor bypass valve 200, so that it is possible to solve the aforementioned problem generated at the initial stage of the boom descending.

In the meantime, in a case where a control signal of the boom joystick 161 is increased so that the supplied flow rate of the hydraulic pump motor 120 is exceeded or the capacity of the electric motor 110 is exceeded, the boom assistant valve 144 is connected by the controller 160 so that the flow rate of the main pump 140 is supplied to the boom cylinder 105 side.

Hereinafter, a method of controlling the hybrid excavator boom actuating system according to the exemplary embodiment of the present disclosure will be described.

Referring to FIG. 6, first, an amount of operation of the boom joystick 161 is detected (S10), and ascending or descending of the boom 100 is determined according to the detected amount of operation (S20).

In a case where the boom 100 ascends, the first control valve 151 is opened (S30), and driving power of the boom 100 according to the amount of operation of the boom joystick 161 is compared with maximum suppliable power of the electric motor 110 (S40). When the driving power of the boom 100 is smaller than the maximum suppliable power of the electric motor 110, the consumed flow rate of the boom cylinder 105 is compared with a maximum flow rate of the hydraulic pump motor 120 (S50).

As a result of the comparison, when the consumed flow rate of the boom cylinder 105 is smaller than the maximum flow rate of the hydraulic pump motor 120, an operation of disconnecting the boom assistant valve 144 is performed (S60). In the meantime, when the driving power of the boom 100 is larger than the maximum suppliable power of the electric motor 110, a process of supplying deficient hydraulic fluid is performed by opening the boom assistant valve 144 (S70) to connect the main pump 140.

In the meantime, when the boom 100 descends, the second control valve 152 is opened (S80). Further, the operation of the hydraulic motor pump 120 is stopped, that is, the supply of the power from the electric motor 110 to the hydraulic motor pump 120 is stopped, and the outlet line 121 and the inlet line 122 are interconnected by switching the motor bypass valve 200 (S90 and S100). Accordingly, all of the flow rate at the head 106 side of the boom cylinder are transferred to the outlet line 121 by passing through the inlet line 121 and the motor bypass valve 200. A part of the flow rate supplied to the outlet line 121 is supplied to the rod 107 side of the boom cylinder, and the surplus flow rate is discharged to the tank.

Next, the controller determines whether the discharged flow rate is equal to or larger than the predetermined flow rate (S110). When the discharged flow rateflow rate of the boom head 106 is less than the predetermined flow rate, a current setting state is continuously maintained.

In the meantime, when the discharged flow rate of the boom head 106 is equal to or larger than the predetermined flow rate, it is determined that the discharged flow rate at the boom head 106 side is sufficient, so that the outlet line 121 is disconnected from the inlet line 122 by switching the motor bypass valve 200 (S130). Accordingly, the flow rate discharged from the boom cylinder head 106 is supplied to the hydraulic motor pump 120, so that the hydraulic motor pump 120 is operated as a hydraulic motor by the supplied high pressure pressurized fluid to regenerate boom energy.

Particularly, regenerative power of the boom 100 is compared with maximum regenerable power of the electric motor 110 (S140). As a result of the comparison, when the regenerative power of the boom 100 is smaller than the maximum regenerable power of the electric motor 110, the regenerative flow rate of the boom cylinder 105 is compared with the allowed flow rate of the hydraulic pump motor 120 (S150). In this case, when the regenerative flow rate of the boom cylinder 105 is smaller than the allowed flow rate of the hydraulic pump motor 120, the first control valve 151 is disconnected (S160). In the meantime, when the regenerative flow rate of the boom cylinder 105 is larger than the allowed flow rate of the hydraulic pump motor 120, the first control valve 151 is connected so that the surplus flow rate is discharged to the tank, and even when the regenerative power of the boom 100 is larger than the maximum regenerable power of the electric motor 110, the first control valve 151 is connected so that the surplus flow rate is discharged to the tank (S170).

As described above, in the hybrid excavator boom driving system and the method of controlling the same according to the exemplary embodiment of the present disclosure, the boom 100 is driven by using the electric motor 110 and the hydraulic pump motor 120 when the boom 100 ascends, so that it is possible to improve fuel efficiency by removing a loss generated in the hydraulic system during the fine operation with the small flow rate.

Further, the flow rate discharged from the head 106 of the boom cylinder is supplied toward the outlet line 121 by using the motor bypass valve 200 at the initial stage of the descending of the boom 100, so that the system may be stably operated.

Further, when the descending of the boom 100 is initiated and it is determined that the hydraulic motor pump 120 may be stably driven because the discharged flow rate of the head 106 of the boom cylinder is sufficient, the flow rate discharged from the head 106 of the boom cylinder may be supplied to the hydraulic motor pump 120 by switching the motor bypass valve 200, so that it is possible to prevent a control and operational characteristic of the hydraulic motor pump 120 from being unstable.

Further, the flow rate necessary in the initial fine operation section when the boom 100 is independently operated is supplied from the electric motor 110 and the hydraulic pump motor 120, and approximately, the portion exceeding the portion corresponding to the maximum flow rate and power supplied by the boom 100 may be supplied by using the existing hydraulic system including the main pumps 140.

The present disclosure may be used for providing effects of minimizing an energy loss when work is performed by using an excavator, securing operational performance of the boom, and recovering regenerable energy of the boom.

Although the present disclosure has been described with reference to exemplary and preferred embodiments, workers skilled in the art will recognize that changes may be made in form and detail without departing from the spirit and scope of the disclosure.

The invention claimed is:

1. A boom actuating system for use with a hybrid excavator, comprising:

an electric motor operated as a motor or a generator;

an electricity storage device configured to store electricity generated in the electric motor;

a hydraulic pump motor driven by the electric motor to supply hydraulic fluid to a boom;

a boom control valve configured to selectively connect or disconnect an outlet line and an inlet line of the hydraulic pump motor to or from a head or a rod of a boom cylinder operating the boom;

a motor bypass valve connected to the outlet line and the inlet line to interconnect the outlet line and the inlet line or disconnect the outlet line from the inlet line; and a controller configured to control the electric motor, the hydraulic pump motor, the boom control valve, and the motor bypass valve;

wherein in a case where a flow rate discharged from the head of the boom after the descending of the boom is initiated is equal to or larger than a predetermined value, the controller operates the hydraulic pump motor, and switches the motor bypass valve so as to disconnect the outlet line and the inlet line.

2. The boom actuating system of claim 1, wherein when descending of the boom is initiated, the controller switches the motor bypass valve so that the outlet line and the inlet line are interconnected.

3. The boom actuating system of claim 2, further comprising:

a second control valve configured to selectively connect the outlet line and a tank, wherein the controller switches the second control valve to interconnect the outlet line and the tank when the boom descends, so that the flow rate discharged from one side of the boom is returned to the tank through the second control valve or supplied to the other side of the boom after passing through the boom control valve, the inlet line, and the hydraulic pump motor, and the electric motor is operated as the generator by the hydraulic pump motor driven by the flow rate discharged from the one side of the boom and then supplied to the other side of the boom or the tank when the boom descends, and the generated electric power is stored in an electricity storage device.

4. The boom actuating system of claim 1, further comprising:

main pumps configured to supply hydraulic fluid to other working devices, except for the boom, and receive power from a power source separately installed from the electric motor;

a boom assistant line configured to guide a flow rate supplied from the main pumps to the outlet line; and a boom assistant valve configured to selectively open or close the boom assistant line, wherein in a case where the flow rate discharged from the hydraulic pump motor and supplied to the boom through the outlet line is smaller than a necessary flow rate, the controller opens the boom assistant valve so that the flow rate supplied from the main pumps is additionally supplied to the boom.

5. The boom actuating system of claim 4, further comprising:

a second control valve configured to selectively connect the outlet line and a tank, wherein the controller switches the second control valve to interconnect the outlet line and the tank when the boom descends, so that the flow rate discharged from one side of the boom is returned to the tank through the second control valve or supplied to the other side of the boom after passing through the boom control valve, the inlet line, and the hydraulic pump motor, and the electric motor is operated as the generator by the hydraulic pump motor driven by the flow rate discharged from the one side of the boom and then supplied to the other side of the boom or the tank when the boom descends, and the generated electric power is stored in an electricity storage device.

6. The boom actuating system of claim 1, further comprising:

a second control valve configured to selectively connect the outlet line and a tank, wherein the controller switches the second control valve to interconnect the outlet line and the tank when the boom descends, so that the flow rate discharged from one side of the boom is returned to the tank through the second control valve or supplied to the other side of the boom after passing through the boom control valve, the inlet line, and the hydraulic pump motor, and the electric motor is operated as the generator by the hydraulic pump motor driven by the flow rate discharged from the one side of the boom and then supplied to the other side of the boom or the tank when the boom descends, and the generated electric power is stored in an electricity storage device.

7. A method of controlling a boom actuating system for use with a hybrid excavator, comprising:

detecting an amount of operation of a boom joystick;

determining whether a boom descends according to the operation of the boom joystick;

when descending of the boom is initiated, switching a motor bypass valve so as to interconnect an outlet line and an inlet line;

determining whether the flow rate discharged from a head of the boom is equal to or larger than a predetermine value; and when the flow rate is equal to or larger than the predetermine value, operating a hydraulic pump motor, and switching the motor bypass valve so as to disconnect the outlet line and the inlet line.

* * * * *